United States Patent [19]

Deutsch et al.

[11] Patent Number: 4,643,027

[45] Date of Patent: Feb. 17, 1987

[54] APPARATUS FOR TESTING CIGARETTE PACKS AND THE LIKE

[75] Inventors: Reinhard Deutsch, Geesthacht; Klaus Jürgen Pohl, Reinbek; Gerhard Masuch, Hamburg, all of Fed. Rep. of Germany

[73] Assignee: Hauni-Werke Körber & Co. KG., Hamburg, Fed. Rep. of Germany

[21] Appl. No.: 748,771

[22] Filed: Jun. 25, 1985

[30] Foreign Application Priority Data

Jul. 14, 1984 [DE] Fed. Rep. of Germany ..... 3426031

[51] Int. Cl.[4] ..... B65B 57/00

[52] U.S. Cl. ..... 73/432.1; 53/53

[58] Field of Search ..... 73/432 G, 432 R, 432.1; 493/11, 12, 13, 14, 15, 16, 17, 18, 19; 53/53

[56] References Cited

U.S. PATENT DOCUMENTS

| | | | |
|---|---|---|---|
| 2,485,040 | 10/1949 | Cupo | 53/53 |
| 2,991,879 | 7/1961 | Innocenti | 53/53 |
| 3,389,811 | 6/1968 | Frank | 493/16 |
| 3,517,477 | 6/1970 | Thornton | 53/53 |
| 3,735,767 | 5/1973 | Kruse et al. | 53/26 |
| 3,805,477 | 4/1974 | Kruse et al. | 53/55 |
| 3,939,984 | 2/1976 | Butner et al. | 53/53 |
| 3,956,870 | 5/1976 | Kruse et al. | 53/55 |
| 4,011,155 | 3/1977 | Feurstein et al. | 53/53 |
| 4,024,394 | 5/1977 | Reuland | 250/308 |
| 4,510,730 | 4/1985 | Edmondson | 53/53 |
| 4,530,199 | 7/1985 | Manservisi et al. | 53/53 |

*Primary Examiner*—Stewart J. Levy
*Assistant Examiner*—Robert R. Raevis
*Attorney, Agent, or Firm*—Peter K. Kontler

[57] ABSTRACT

Apparatus for testing cigarette packs for the presence or absence of several defects including the configuration of the packs, the orientation of their constituents and the quality of bonds between overlapping constituents has an intermittently driven turret with an annulus of receptacles which are supplied with packs by an intermittently driven feeding conveyor. The receptacles have relatively small engaging devices in the form of spring-biased strips, suction cups and/or simple abutments to locate and hold the packs therein in such a way that by far the major part of each pack remains accessible and exposed for testing by a series of photocells which are disposed at several stations adjacent to the path of movement of the receptacles. Tested defective and satisfactory packs are expelled from their receptacles in two separate portions of the path downstream of the testing stations.

13 Claims, 7 Drawing Figures

APPARATUS FOR TESTING CIGARETTE PACKS AND THE LIKE

BACKGROUND OF THE INVENTION

The present invention relates to improvements in apparatus for testing block-shaped commodities, especially cigarette packs and like parallelepiped products. More particularly, the invention relates to improvements in apparatus which can be utilized with advantage for multiple testing of cigarette packs in cigarette packing machines.

It is well known to repeatedly test cigarette packs in a packing machine for the positioning, orientation, presence, integrity and/or other characteristics of their constituents (normally including an aluminum foil or tinfoil which constitutes the inner envelope, a paper layer or plastic layer which constitutes the outer envelope and a revenue or sealing label which is applied across the top of the pack. A cigarette packing machine is normally provided with a substantial number of testing stations which permit for monitoring of successive stages of the making of a soft or hard pack and whose sensors generate signals denoting the absence of a constituent and/or the detection of an unsatisfactory or improperly applied constituent. It is also known to monitor the condition of semifinished cigarette packs. German Offenlegungsschrift No. 32 19 001 of Sasib discloses an apparatus for transporting partly finished cigarette packs on an endless belt conveyor past a station at which successive packs are provided with labels. Such packs are thereupon transported past a monitoring station having means which detect the presence or absence of labels and generate signals for the ejection of each pack which failed to receive and/or retain a label. Thus, the apparatus of Sasib is designed to detect the presence or absence of a single defect so that a cigarette pack which has advanced beyond the monitoring station can exhibit an open seam on its outer envelope, an improperly folded or improperly adhering flap and/or other defects which remain undetected and are a cause of annoyance to the purchasers.

It happens again and again that a finished cigarette pack which has been monitored at several successive stations exhibits one or more defects which develop subsequent to testing of the pack and/or its constituents for such defects during certain stages of assembly of the pack. For example, the outer flap at the bottom of a so-called soft cigarette pack can properly adhere to the inner flap immediately downstream of the corresponding flap folding station but such outer flap is likely to open at a later stage, e.g., downstream of the labelling station. The corresponding packs remain undetected in presently known cigarette packing machines. Thus, it is desirable and advantageous to ascertain whether or not all constituents of a cigarette pack are or remain properly oriented and/or applied and are actually present upon completion of the last packing step, such as the application of revenue labels or sealing labels. As a rule, the defects most likely to be exhibited by a finished cigarette pack are the absence of one or more constituents (the foil, the outer layer and the label in the case of a soft pack), the location and/or orientation of the label, the configuration or outline of the pack, and the presence or absence of improperly bonded outer flaps. An outwardly extending (improperly bonded or unbonded) outer flap and/or a partially bonded label will change the configuration of the pack so that such configuration departs from the desired configuration and the pack cannot be readily introduced into a carton or the like.

OBJECTS AND SUMMARY OF THE INVENTION

An object of the invention is to provide an apparatus which allows for simple or complex testing of block-shaped commodities, particularly for the testing of cigarette packs in a packing machine, in such a way that the defects of finished packs can be detected even if they occur subsequent to initial monitoring of the commodities for the presence or absence of such defects.

Another object of the invention is to provide a simple, compact and inexpensive testing apparatus which can be installed in or associated with existing cigarette packing and like machines.

A further object of the invention is to provide the apparatus with novel and improved means for receiving and engaging the commodities which require testing.

An additional object of the invention is to provide the apparatus with novel and improved means for ensuring reliable testing of each commodity for the presence or absence of any one of a number of different defects.

Still another object of the invention is to provide a testing apparatus which can be used in lieu of several heretofore known testing apparatus in a cigarette packing or like machine.

A further object of the invention is to provide an apparatus which treats the commodities gently and which can test a substantial number of commodities per unit of time so that it does not constitute a bottleneck in a production line for the making of plain or filter cigarettes or the like.

Another object of the invention is to provide the apparatus with a novel and improved conveyor for the transport of cigarette packs or analogous block-shaped commodities past one or more testing stations.

An additional object of the invention is to provide an apparatus which can reliably test finished cigarette packs for the presence or absence of their standard constituents, for the orientation and/or location of labels and/or for the acceptability of their outlines.

Another object of the invention is to provide a novel and improved method of testing finished cigarette packs or like block-shaped commodities.

One feature of the invention resides in the provision of an apparatus for testing block-shaped parallelepiped commodities, particularly for testing finished cigarette packs in a packing machine, by monitoring selected portions of the external surfaces of the commodities. The apparatus comprises a plurality of receptacles each of which serves to receive one commodity at a time and each of which has means for engaging and holding only a small part of the external surface of the respective commodity so that at least each selected portion of the external surface of the commodity in a receptacle remains exposed and accessible for testing, and means for driving the conveyor so as to advance the receptacles in a predetermined direction and along a predetermined path, preferably along an endless circular path.

The apparatus further comprises means for monitoring successive commodities in at least one predetermined portion of the path for the presence or absence of one or more constituents of the commodities, for ascertaining the orientation of one or more constituents of successive commodities and/or for ascertaining the configuration of successive commodities. Two or more discrete testing stations can be provided one after the other, as considered in the direction of advancement of the receptacles along their path.

In accordance with one presently preferred embodiment of the invention, commodities of the type having several corner portions (typical examples of such commodities are cigarette packs) can be properly held by retaining means each of which includes several devices for engaging at least some corner portions of commodities in the respective receptacles. At least one retaining device in each of the receptacles can be provided with a substantially triangular surface which comes into actual contact with the adjacent portion of the exposed surface of the commodity in the corresponding receptacle.

If the commodities are of the type having flaps, revenue labels or analogous parts which assume first positions in the case of acceptable (satisfactory) commodities and second positions in the case of defective (unsatisfactory) commodities, the receptacles preferably define spaces for reception of such components of defective commodities. For example, each receptacle can define a first space which receives an improperly attached or unattached portion of a revenue label and a second space for reception of the outer bottom flap of the outer envelope of a soft cigarette pack if such flap does not properly adhere to the other bottom flap.

Alternatively, each engaging means can comprise two sections (e.g., in the form of narrow elongated rigid or partially flexible strips or panels) which serve to engage two opposite sides of a block-shaped commodity in the respective receptacle. Each such receptacle can further comprise means for yieldably biasing at least one section of the respective engaging means against the corresponding side of the commodity in the respective receptacle.

Still further, the engaging means of each receptacle can comprise two retaining devices which engage two spaced-apart corner portions of the commodity in the respective receptacle; each such retaining device can constitute a substantially V-shaped or L-shaped member. The receptacles preferably define substantially rectangular compartments for the block-shaped commodities and the two V-shaped or L-shaped engaging devices are preferably disposed diagonally opposite each other in the compartment of the respective receptacle.

Alternatively, each engaging means can comprise at least one device (such as a simple suction cup) which is operable to attract a commodity by suction. Each such engaging means can further comprise at least one lateral abutment or stop for the commodity which is attracted by the respective engaging device (suction cup).

The conveyor preferably comprises a rotary turret which is indexible in stepwise fashion and whose receptacles form an annulus with axially extending compartments. Each compartment extends all the way from one axial end to the other axial end of the turret.

The apparatus further comprises means (e.g., an intermittently driven endless belt or chain conveyor) for feeding discrete commodities into successive receptacles in a predetermined portion of the path. The feeding means admits commodities into successive receptacles during intervals between successive stepwise advances of the receptacles. Means is also provided for expelling tested defective and satisfactory commodities from at least one further portion of the path downstream of the predetermined portion, as considered in the direction of indexing of the turret, always during the intervals between successive intermittent advances of the receptacles along their path.

In accordance with a presently preferred embodiment, the commodities are fed into successive empty receptacles in a first portion of the path, the commodities are thereupon tested in at least one second portion of the path downstream of the first portion, the tested defective commodities are expelled from their receptacles in a third portion of the path, and the tested satisfactory commodities are expelled from their receptacles in a fourth portion of the path. The third and fourth portions are located downstream of the second portion of the path, and the third portion can precede the fourth portion or vice versa.

Another feature of the invention resides in the provision of a method of testing block-shaped commodities, particularly cigarette packs in a packing machine, by monitoring selected portions of the external surfaces of the commodities. The method comprises the steps of advancing a succession of preferably equidistant randomly distributed satisfactory and defective commodities along a predetermined path including engaging and holding relatively or very small portions of the external surfaces of the commodities so that at least the selected portions of each commodity remain exposed and accessible for testing, monitoring several selected portions of each commodity, preferably in several successive portions of the path, expelling tested defective commodities from a further portion of the path downstream of the second portion, and expelling tested satisfactory commodities from an additional portion of the path downstream of the second portion and downstream or upstream of the third portion. The advancing step preferably comprises moving the commodities in stepwise fashion, and each expelling step preferably comprises expelling defective and satisfactory commodities from their receptacles during intervals between successive stepwise advances of the receptacles. The monitoring step can include photoelectrically scanning selected portions of the commodities to ascertain the configuration of the commodities, to detect the presence or absence of unbonded flaps, revenue labels, sealing labels and like constituents of a cigarette pack and/or to ascertain whether or not the orientation of one or more constituents is satisfactory (e.g., whether or not a revenue label is properly applied over the top of a cigarette pack).

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
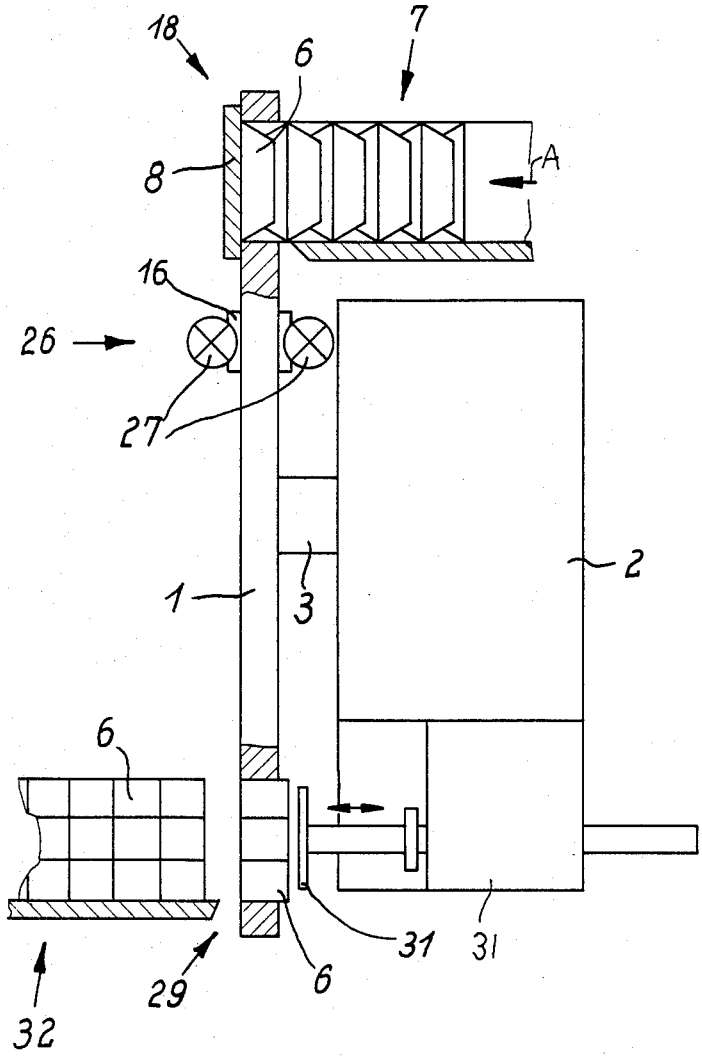
FIG. 1 is a partly side elevational and partly central vertical sectional view of a testing apparatus which embodies one form of the invention.
Figure 2:
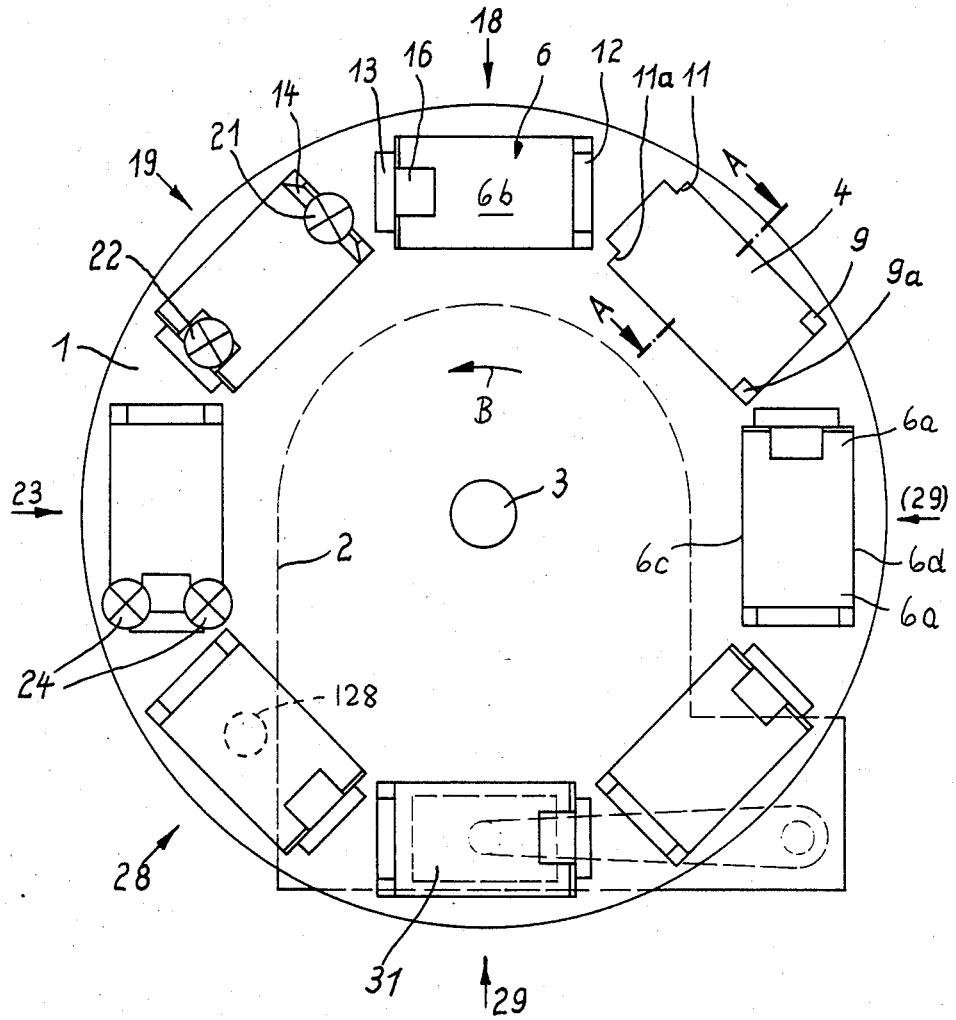
FIG. 2 is a front elevational view of the apparatus as seen from the left-hand side of FIG. 1, with certain parts at the feeding and removing stations omitted.

FIGS. 1 and 2 show a testing apparatus which is installed in a cigarette packing machine or is adjacent to the outlet of such machine. The packing machine may be of the type disclosed in commonly owned U.S. Pats. Nos. 3,735,767, 3,805,477 and 3,956,870. The apparatus comprises a turret-shaped conveyor 1 which is indexible about the horizontal axis of a shaft 3. The means for driving the shaft 3 so as to index the turret 1 in stepwise fashion through predetermined angles includes a transmission 2 whose input element can receive torque from the main prime mover the packing machine. The turret 1 is formed with eight equidistant receptacles 4 each of which defines a rectangular compartment and comprises means for engaging and releasably holding therein discrete finished cigarette packs 6. The means for feeding discrete packs 6 into the compartments of successive receptacles 4 (during the intervals between successive stepwise advances of the turret 1) comprises a second conveyor 7 (e.g., an endless belt or chain conveyor) which advances a series of abutting packs 6 in the direction which is indicated by the arrow A, i.e., in parallelism with the axis of the shaft 3 at a pack supplying station 18. A stationary plate-like stop 8 is mounted at the station 18 to the left of the turret 1, as viewed in FIG. 1, to determine the extent of penetration of the foremost pack 6 of the series of abutting packs on the feeding conveyor 7. The depth of each compartment, as viewed in the direction of arrow A, matches the corresponding dimension of a pack 6. The conveyor 7 is driven intermittently in synchronism with the turret 1 so that it advances the series of abutting packs 6 thereon stepwise, always through a distance corresponding to the depth of a compartment, during each interval of dwell of the turret.

As shown in FIG. 2, the engaging devices of each receptacle 4 are designed to merely engage and hold the four corners 6*a*of the pack 6 in the respective compartment. The engaging devices include two front engaging devices 11, 11*a* which flank a properly applied revenue or sealing label 16 on the respective pack 6 and two rear engaging devices 9, 9*a* which engage the bottom end of the respective pack in the region of the outer bottom flap 14 of the respective outer envelope 6*b* of the pack.

Figure 3:
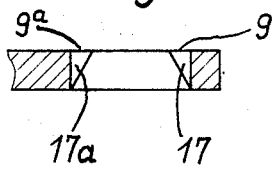
FIG. 3 is a fragmentary sectional view as seen in the direction of arrows from the line A—A of FIG. 2.

The engaging devices 9, 9*a* of each receptacle 4 define a space 12 which provides room for an open (unbonded) outer flap 14 (see the testing station 19 of FIG. 2) of an unsatisfactory pack 6 so that such open flap (which causes the outline or configuration of the respective pack to depart from the desired or prescribed outline) can be readily detected by appropriate testing or monitoring devices at one of the testing stations 19, 23 which follow the pack supplying station 18, as viewed in the direction of the arrow B (denoting the direction of intermittent stepwise movement of the turret 1). As can be seen in FIG. 3, the engaging devices 9, 9*a* are respectively provided with substantially triangular surfaces 17, 17*a* which come in direct contact with the adjacent-portion of a properly inserted pack 6 in the respective compartment. Similar substantially triangular contact surfaces can be provided on the engaging devices 11, 11*a* which are to contact the top surface of a properly inserted pack 6. Each properly inserted pack 6 is held by friction as a result of engagement with the corresponding devices 9, 9*a* and 11, 11*a* and with a force which suffices to ensure that it is properly oriented with reference to the monitoring elements at the testing stations 19 and 23. The means for expelling a freshly tested pack 6 from its receptacle 4 must merely overcome the friction between such pack and the corresponding engaging devices 9, 9*a*, 11 and 11*a*. The engaging devices 11 and 11*a* of each receptacle 4 define a space 13 which provides room for a portion of an improperly bonded label 16 so that such unbonded portion of the label can be readily detected at the station 19 and/or 23 because it causes the configuration or outline of the respective pack to depart from the expected or acceptable outline.

The overall area of contact between the external surface of a pack 6 and the engaging devices 9, 9*a*, 11, 11*a* in the respective receptacle 4 is small or very small and is invariably only a small fraction of the entire external surface of the pack. This renders it possible to monitor each pack 6 in a number of different respects. One of the tests can involve detecting the presence or absence of improperly bonded outer flaps, such as 14. Another test can involve detecting the presence or absence of improperly bonded labels 16. A further test can involve detecting the orientation and location of the labels, i.e., whether or not the labels extend exactly transversely of the top sides of the respective packs and/or whether or not a label is nearer to the one or the other lateral side 6*c* or 6*d* of the respective pack. A further test can involve monitoring the shape of the corners 6*a*of the packs, the presence or absence of smudges and/or a combination of such defects. Furthermore, two or more monitoring operations can be carried out at one and the same testing station. As shown in FIG. 2, the means for monitoring the packs 6 at the first testing station 19 comprises two monitoring elements 21 and 22 the first of which is in the process of detecting an unbonded outer bottom flap 14 and the other of which is in the process of detecting the presence of a label 16. The monitoring means at the second testing station 23 of FIG. 2 comprises two monitoring elements 24 which can ascertain the orientation of the labels 16 as well as whether or not a label is properly located midway between the lateral sides 6*c*, 6*d* of the respective pack 6.

FIG. 1 shows a further testing station 26 with two monitoring elements 27 which are disposed at the opposite sides of the path of the packs 6 in the respective receptacles 4 and serve to detect whether or not the marginal portions of successive labels 16 are properly bonded to the corresponding major surfaces of the packs 6. The label 16 which is actually shown in FIG. 1 at the station 26 is improperly applied because its two marginal portions extend beyond the respective sides of the turret 1.

Referring again to FIG. 2, the reference character 28 denotes a first ejecting station wherein a nozzle 128 or another suitable ejector is provided to expel defective packs 6 from the corresponding receptacles 4 in response to signals which are generated by the monitoring elements 21, 22, 24 and/or 27 and are properly delayed (e.g., by shift registers) to thus ensure that the nozzle 128 opens and allows a jet of compressed air or another suitable gas to expel a defective pack 6 during the interval between successive stepwise advances of the respective receptacle 4 to and from the ejecting station 28. Circuits for processing and delaying signals which are used to effect ejection of defective goods (e.g., plain or filter cigarettes) are well known in the art. Reference may be had, for example, to commonly owned U.S Pat. No. 4,024,394.

Satisfactory packs 6 advance beyond the ejecting station 28 to a second ejecting station 29 to be expelled from their receptacles 4 by a reciprocable pusher 31 which receives motion from the driving means 2 or from a separate unit and is arranged to briefly penetrate into the adjacent receptacle 4 during each interval between successive stepwise indexing movements of the turret 1. The station 29 can be located upstream of the station 28 but is preferably located downstream thereof because this simplifies the controls for the pusher 31, i.e., the latter can penetrate into successive receptacles 4 irrespective of whether or not such receptacles contain (satisfactory) cigarette packs 6. The presently preferred mode of reciprocating the pusher 31 is by means of a double-acting cylinder and piston assembly. The pusher 31 transfers successive satisfactory packs 6 onto a take-off conveyor 32 which can deliver satisfactory packs to the next processing station, e.g., to a carton filling machine or to storage.

For example, the monitoring devices 21 and 27 can constitute photoelectric detectors of the type having a source of radiation and a photoelectronic transducer. Suitable detectors of such character are known as TYP ML 5 manufactured by the Firm Visolux of German Federal Republic. The monitoring devices 22 and 24 may constitute reflection type photocells, for example, those known as TYP NT 6 (manufactured by the Firm Sick, German Federal Republic). The sequence of testing stations 19, 23 and 26 and/or one or more additional testing stations can be altered practically at will, as long as they are located upstream of the ejecting station 28 for defective packs 6. Furthermore, the second ejecting station 29 can be transferred to the three o'clock position of FIG. 2 as indicated by the reference character (29). The number of receptacles 4 in the turret 1 can be increased to nine or more or reduced to seven or less.

Figure 4:
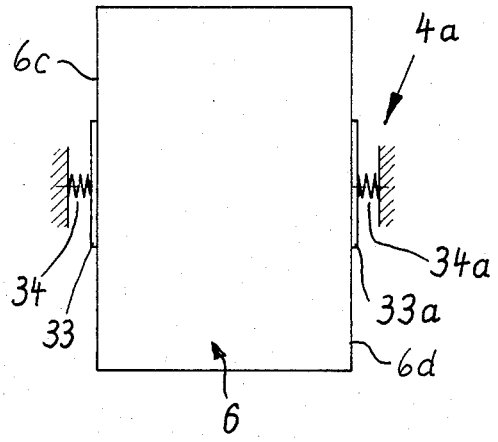
FIG. 4 is a schematic front elevational view of a modified receptacle for cigarette packs which can be used in the apparatus of FIGS. 1 to 3.

The receptacles 4 which are shown in FIGS. 1 to 3 constitute but one of various types of receptacles which can be utilized in the testing apparatus of the present invention. FIG. 4 shows a modified receptacle **4*a* whose pack-engaging means comprises two sections in the form of plate-like or strip-shaped rigid or substantially rigid engaging devices 33 and 33*a* which can engage the adjacent lateral sides 6*c* and 6*d* of a pack 6 in the compartment of the receptacle. In addition, the receptacle 4*a* comprises two coil springs 34, 34*a* or otherwise configurated means for yieldably biasing the respective engaging devices 33, 33*a* against the adjacent sides of the pack in the receptacle. It is often sufficient to fixedly mount one of the devices 33, 33*a* in the respective receptacle 4*a* and to bias the other engaging device toward the fixedly installed engaging device by one or more coil springs or the like. It is evident that the bias of the springs shown in FIG. 4 should suffice to adequately retain a pack 6 in the receptacle 4*a*** but is far from being so pronounced as to cause damage to or undue deformation of the pack.

Figure 5:
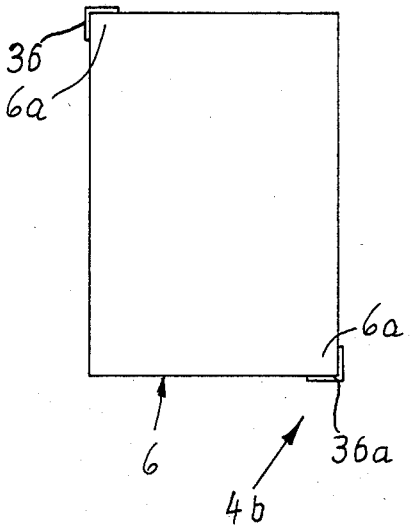
FIG. 5 is a similar view of a different receptacle.

FIG. 5 shows a portion of a modified receptacle **4*b* whose pack engaging devices comprise two substantially V-shaped or L-shaped members 36, 36*a* serving to engage two corner portions 6*a* of a properly inserted pack. The members 36, 36*a* are disposed diagonally opposite each other in the rectangular compartment which is defined by the receptacle 4*b*. The inner sides of the members 36, 36*a* can include wedge-like surfaces which hold a properly inserted pack 6** with requisite friction but without undue deformation.

Figure 6:
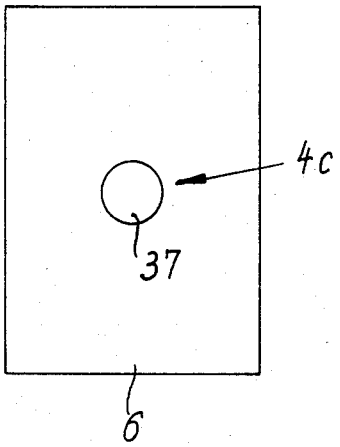
FIG. 6 is a similar view of an additional receptacle.

FIG. 6 shows a portion of a further receptacle **4*c* which includes at least one suction cup 37 constituting a means for holding a pack 6 in a predetermined position by suction. The suction cup 37 can be movably mounted in the testing apparatus so that it can be utilized as a means for extracting (i.e., ejecting) defective packs 6 from their respective receptacles 4*c***.

Figure 7:
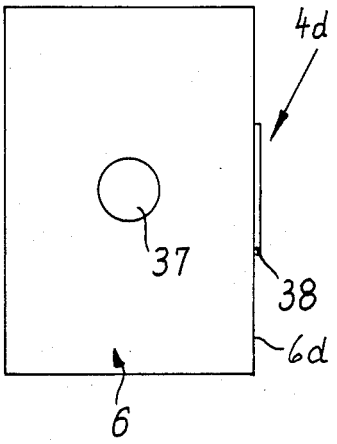
FIG. 7 is a similar view of a receptacle constituting a modification of that which is shown in FIG. 6.

Instead of holding a pack 6 exclusively by suction (as shown in FIG. 6), a turret-shaped or an otherwise configurated conveyor of the testing apparatus can comprise receptacles **4*d* having suction cups 37 as well as suitable stop means (e.g., the strip 38 shown in FIG. 7) to ensure more reliable orientation of a pack 6 in the respective receptacle 4*d*. The strip 38 engages the lateral side 6*d* of the pack 6 in the compartment of the receptacle 4*d* of FIG. 7**.

Other types of receptacles can be used with equal or similar advantage. For example, the suction cup 37 of FIG. 6 can be used in conjunction with the L-shaped or V-shaped engaging devices 36, **36*a* of FIG. 5. All that counts is to ensure that the major part of the external surface of each finished pack 6** remains exposed and accessible for testing during transport of the pack past one or more testing stations. At least those selected portions of each pack (for example, the bottom end and the top end of each pack) which are most likely to exhibit defects are fully accessible to mechanical, optical and/or other suitable testing or monitoring means.

An important advantage of the improved apparatus is that it allows for simultaneous or sequential testing of several similar or different characteristics or parameters of finished packs or analogous block-shaped commodities so that each and every commodity which is delivered to the next-following processing station (e.g., to the aforementioned carton filling machine) is devoid of defects and the machine at the next processing station can operate at a higher speed as well as with fewer interruptions than heretofore because it receives only such packs which are devoid of open flaps, improperly applied labels and like defects. The complexity of the testing operation and the number of testing stations can be selected practically at will, and all such stations can be accommodated in a relatively small area adjacent to the preferably endless path of the receptacles 4, **4*a*, 4*b* 4*c* or 4*d* on the turret 1** or an analogous conveyor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for testing block-shaped commodities of the type having a plurality of corner protions, particularly cigarette packs in a packing machine, by monitoring selected portions of such commodities, comprising a conveyor having a plurality of receptacles each arranged to receive one commodity at a time and each having means for engaging and holding a small part of the external surface of the respective commodity so that at least said selected portions of the commodity in a receptacle remain exposed, said engaging means including several devices for engaging at least some corner portions of the commodities in the respective receptacles, at least one of said devices in each of said receptacles having a substantially triangular commodity-contacting surface; means for driving said conveyor so as to advance said receptacles in a predetermined direction and along a predetermined path; and means for monitoring a plurality of different parameters of each commodity in at least one portion of said path.

2. The apparatus of claim 1 for testing commodities of the type having a plurality of components, wherein said monitoring means comprises means for monitoring successive commodities for the presence or absence of the components of the commodities.

3. The apparatus of claim 1 for testing commodities of the type having a plurality of components and the components of satisfactory commodities assume predetermined orientations, wherein said monitoring means comprises means for monitoring the orientation of the components of successive commodities.

4. The apparatus of claim wherein said monitoring means comprises means for monitoring the outlines of successive commodities.

5. The apparatus of claim 1 for testing commodities having components which assume first positions on acceptable commodities and second positions on defective commodities, said receptacles defining spaces for reception of the components of defective commodities.

6. The apparatus of claim 5, wherein said spaces are designed to receive the bottom flaps and/or portions of revenue or sealing labels of cigarette packs.

7. The apparatus of claim 1, wherein said conveyor includes a rotary turret.

8. The apparatus of claim 1, wherein said driving means includes means for moving the conveyor in stepwise fashion.

9. The apparatus of claim 8, further comprising means for feeding commodities into successive receptacles in a second portion of said path, said feeding means including an intermittently operated second conveyor arranged to admit commodities into successive receptacles during intervals between successive intermittent movements of receptacles along said path.

10. The apparatus of claim 9, further comprising means for expelling tested commodities from receptacles in at least one further portion of said path during intervals between successive movements of said receptacles, said further portion being located downstream of said second portion as considered in said direction.

11. The apparatus of claim 1, further comprising means for admitting commodities into successive receptacles in a second portion of said path, said one portion of said path being located downstream of said second portion as considered in said direction, means for expelling tested defective commodities from the respective receptacles in a third portion of said path, and means for expelling tested satisfactory commodities from a fourth portion of said path, said third and fourth portions being located downstream of said one portion of said path.

12. Apparatus for testing block-shaped commodities of the type having at least one pair of spaced-apart corner portions, particularly cigarette packs in a packing machine, by monitoring selected portions of such commodities, comprising a conveyor having a plurality of receptacles each arranged to receive one commodity at a time and each having means for engaging and holding a small part of the external surface of the respective commodity so that at least said selected portions of the commodity in a receptacle remain exposed, the engaging means of each of said receptacles including two retaining devices for the corner portions of the commodity in the respective receptacle; means for driving said conveyor so as to advance said receptacles in a predetermined direction and along a predetermined path; and means for monitoring a plurality of different parameters of each commodity in at least one portion of said path.

13. The apparatus of claim 12, wherein each of said receptacles defines a substantially rectangular compartment for a commodity therein and said retaining devices are disposed in such compartments substantially diagonally opposite each other.

* * * * *